US007165377B2

(12) United States Patent
Gillet et al.

(10) Patent No.: US 7,165,377 B2
(45) Date of Patent: Jan. 23, 2007

(54) METHOD AND MACHINE FOR PREPARING POSTMAN'S ROUTE IN ONE SINGLE PASS

(75) Inventors: Francois Gillet, Lyons (FR); Chifflet Raymond, Guilherand Grange (FR); Olivier De Sousa, Valence (FR)

(73) Assignee: Solystic, Gentilly Cedex (FR)

( * ) Notice: Subject to any disclaimer, the term of this patent is extended or adjusted under 35 U.S.C. 154(b) by 0 days.

(21) Appl. No.: 10/475,173

(22) PCT Filed: Jul. 1, 2003

(86) PCT No.: PCT/FR03/02033

§ 371 (c)(1),
(2), (4) Date: Oct. 17, 2003

(87) PCT Pub. No.: WO2004/004931

PCT Pub. Date: Jan. 15, 2004

(65) Prior Publication Data

US 2004/0261366 A1 Dec. 30, 2004

(30) Foreign Application Priority Data

Jul. 3, 2002 (FR) ..... 02 08307

(51) Int. Cl.
*B65B 21/06* (2006.01)
*B65B 11/06* (2006.01)
*B65B 27/00* (2006.01)

(52) U.S. Cl. ..... 53/443; 53/228; 53/447; 53/587

(58) Field of Classification Search ..... 53/176, 53/399, 443, 447, 469, 228, 587; 209/584

See application file for complete search history.

(56) References Cited

U.S. PATENT DOCUMENTS

| | | | | |
|---|---|---|---|---|
| 2,937,739 | A | 5/1960 | Levy | |
| 4,601,155 | A * | 7/1986 | Lewis | 53/176 |
| 4,863,037 | A * | 9/1989 | Stevens et al. | 53/381.3 |
| 5,459,670 | A * | 10/1995 | Johnson et al. | 700/224 |
| 5,460,273 | A * | 10/1995 | Stevens et al. | 209/584 |
| 5,464,099 | A * | 11/1995 | Stevens et al. | 209/3.1 |

(Continued)

FOREIGN PATENT DOCUMENTS

| | | |
|---|---|---|
| DE | 557 052 C | 8/1932 |

(Continued)

*Primary Examiner*—Christopher R. Harmon
(74) *Attorney, Agent, or Firm*—Sughrue Mion, PLLC

(57) ABSTRACT

In order to be able to prepare a postman's walk containing both letters (L) and "large format" flat postal objects (P) in a single pass:

the letters and the large format objects are moved in series using a conveyor (3) over the bins of a bin carrousel (4) that is stationary, with the successive bins of the carrousel corresponding to different successive delivery points in the postman's walk;

each letter or large format object on the conveyor is directed towards that one of the bins of the carrousel which corresponds to the delivery point for the letter or large format object; and when all of the letters and large format objects of the postman's walk have been grouped together by delivery points in the bins of carrousel, the bin carrousel is set into motion in order to bring each bin in succession to a location (5) where the bin is emptied into a receptacle.

6 Claims, 2 Drawing Sheets

U.S. PATENT DOCUMENTS 5,667,078 A * 9/1997 Walach ..... 209/584
5,673,193 A * 9/1997 Brust et al. ..... 705/406
6,303,889 B1 * 10/2001 Hayduchok et al. ..... 209/584
6,555,776 B1 * 4/2003 Roth et al. ..... 209/584
6,581,782 B1 * 6/2003 Reed ..... 209/702

FOREIGN PATENT DOCUMENTS

FR 2 708 488 A 2/1995

* cited by examiner

FIG_1
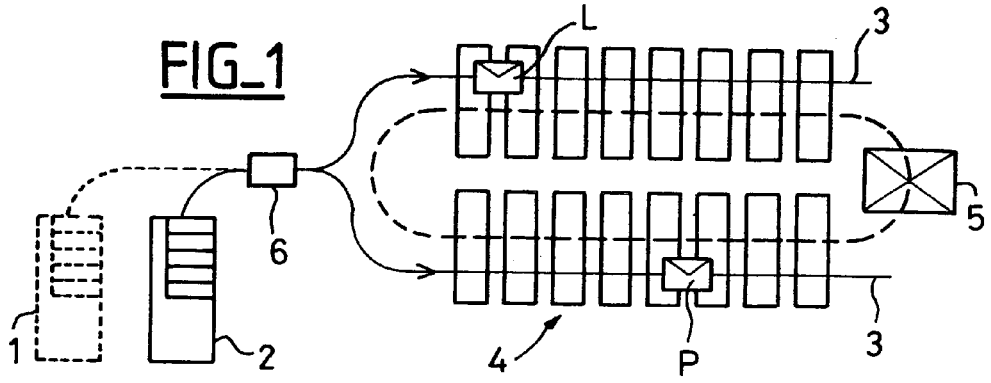
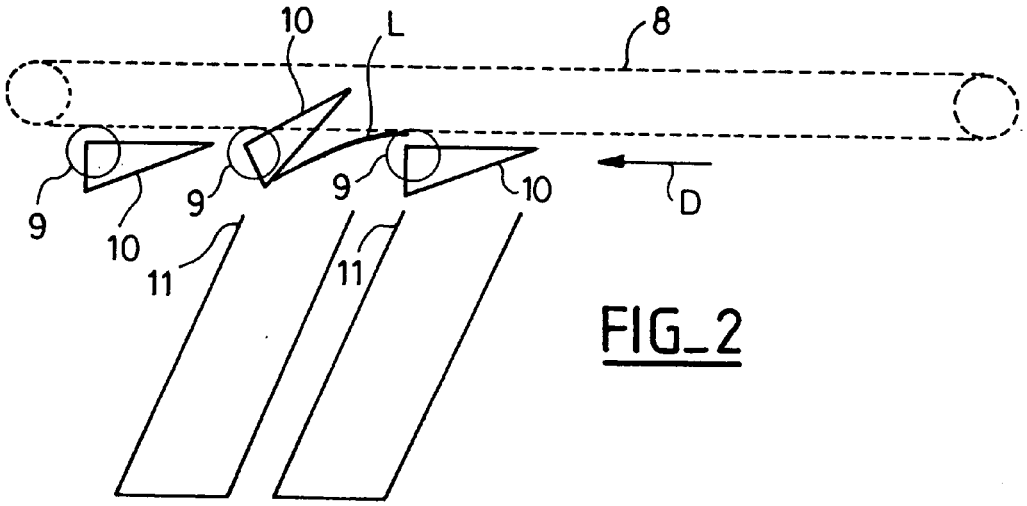
FIG_2
FIG_3
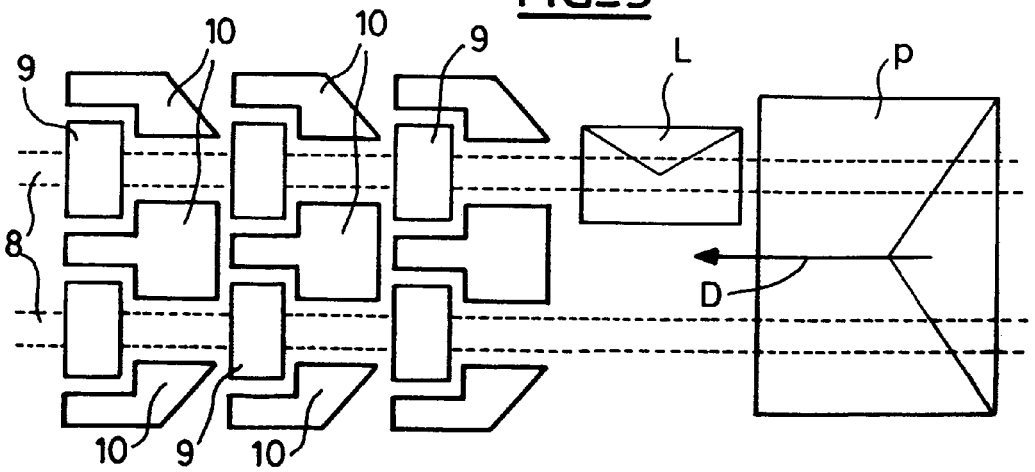

METHOD AND MACHINE FOR PREPARING POSTMAN'S ROUTE IN ONE SINGLE PASS

The invention relates to a method of preparing a postman's walk containing both letters and "large format" flat postal-objects. Preparing a postman's walk consists in grouping together the mail items of the postman's walk by delivery points and in placing the volumes to be delivered at each of the delivery points in the order of the postman's walk. This processing may be performed manually or by using "sequencing" machines which commonly work in one or more (generally two or three) passes. In addition, currently for a postman's walk made up both of letters and of large format objects, postmen are in the habit of preparing a single walk including both small format letters and large format objects. Unfortunately, preparing such a postman's walk currently requires a large number of handling operations, which increases the cost related to delivery, which cost currently represents ⅔ of the total cost of processing a mail item.

An object of the invention is to provide a method as indicated above for preparing a postman's walk containing both letters and large format postal objects in a single pass. In the invention, this method is characterized in that it consists in the following steps:

- the letters and the large format objects are moved in series using a conveyor over the bins of a bin carrousel that is stationary, with the successive bins of the carrousel corresponding to different successive delivery points in the postman's walk;
- each letter or large format object on the conveyor is directed towards that one of the bins of the carrousel which corresponds to the delivery point for the letter or large format object; and
- when all of the letters and large format objects of the postman's walk have been grouped together by delivery points in the bins of carrousel, the bin carrousel is set into motion in order to bring each bin in succession to a location where the bin is emptied into a receptacle.

According to features of the method of the invention:

- the step of emptying the bin into a receptacle consists in opening the bottom of the bin over a bundling system for bundling the contents of the bin;
- the bundling of the contents of the bin consists in a bagging operation;
- the operation of bagging the contents of the bins consists in producing a string of bags; and
- firstly the large format objects are moved over the bins of the bin carrousel for the purpose of being grouped together by delivery points in the bins, this processing then being repeated for the letters.

The invention also provides a machine for preparing a postman's walk containing both letters and "large format" flat postal objects in a single pass, said machine being characterized in that it comprises a bin carrousel having as many bins as there are delivery points in the postman's walk, a conveyor disposed to convey the letters and the large format objects in series over the bins of the bin carrousel, switching means organized to direct each letter or large format object from the conveyor to one of the bins in the carrousel that corresponds to the delivery point for the letter or for the large format object, and a bundling system which serves to bundle the contents of the bins, over which the bins are brought in succession by setting the bin carrousel in motion, and into which each bin is emptied.

The machine also has the following features:

- the bundling system is organized for forming a string of bags, each of which contains the contents of a respective bin;
- the machine further comprises a labelling device suitable for affixing labels on the bags in the string of bags;
- the bundling system has two reels for unreeling respective ones of two sheet strips disposed facing each other so that the contents of each bin are emptied between the two opposite sheet strips, and means are provided for bringing the two opposite sheet strips towards each other and for sealing together the sides of the two sheet strips so as to constitute a bag enclosing the contents of the bin;
- the sheet strips are strips of a plastics material;
- the bundling system comprises means for providing pre-cuts in the zones where consecutive bags meet; and
- the conveyor is a conveyor having belts and rollers, and the switching means are constituted by pivotally mounted flaps.

It can be understood from the above that the bundling is performed in a manner such that the bundles remain connected to one another in the order of the delivery points of the postman's walk. Naturally, no bundle is generated for an empty delivery point, i.e. for a bin of the carrousel that does not contain any letters or large format objects. The bagging with pre-cuts between consecutive bags is advantageous in that it makes it possible to increase the productivity of the postman very significantly because it contributes to simplifying transporting a walk that has been prepared, and to simplifying delivery of the mail, since the bags are separated from one another as the postman reaches the mailboxes.

The method and the machine of the invention for preparing a postman's walk are described below with reference to the drawings, in which:

FIG. 1 is a highly diagrammatic plan view of a machine of the invention for preparing a postman's walk;

FIG. 2 is a highly diagrammatic view of a roller-and-belt conveyor that is part of the machine shown in FIG. 1;

FIG. 3 is a highly diagrammatic view of the switching flaps of the conveyor shown in FIG. 2.

Figure 4:
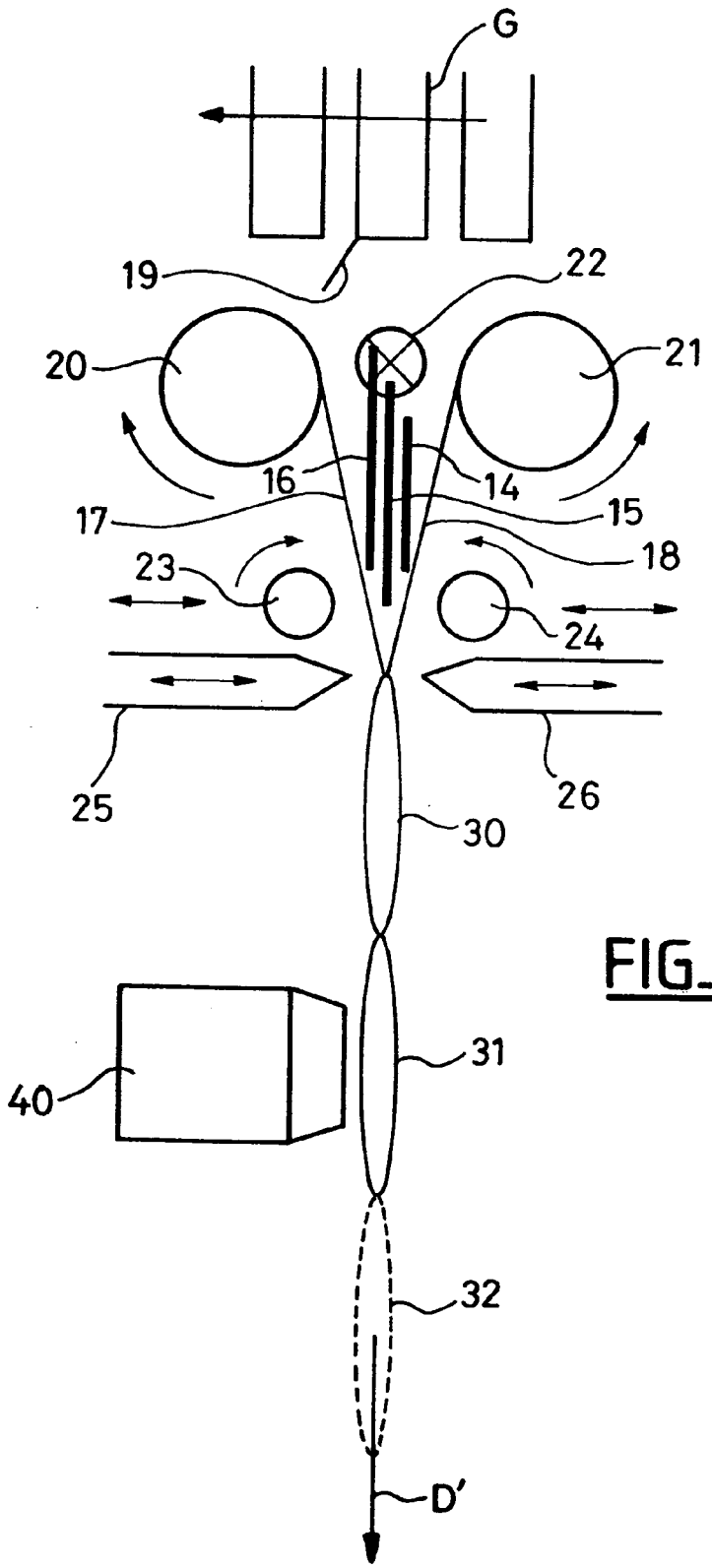
FIG. 4 is a highly diagrammatic view of a bundling system that is part of the machine shown in FIG. 1.

The machine shown in FIG. 1 enables a postman's walk containing both letters and large format objects to be prepared in a single pass. The machine includes an unstacker 1 adapted to serialize a stack of large format objects (commonly referred to as "flats" in the technical literature), and an unstacker 2 adapted to serialize a stack of letters which are objects of smaller format. Naturally, the machine may include a single unstacker such as the unstacker 2 if that stacker is adapted to serialize both large format objects and also letters. The mail items at the outlets of the stackers 1 and 2 are conveyed in series by a conveyor 3 to be moved over the bins of a bin carrousel 4. The bins of the carrousel are open at their tops and are provided with bottoms that can be opened.

The bin carrousel 4 has as many bins as there are delivery points in the postman's walk to be prepared. Each bin thus corresponds to a respective delivery point in the postman's walk, and the successive bins in the carrousel correspond to the successive delivery points in the order of the postman's walk. The conveyor 3 must be organized to be capable of bringing each mail item to a respective one of the bins of the carrousel that corresponds to the delivery point for the mail item when the carrousel is stationary.

With the conveyor and the bin carrousel, it is possible, in a single pass, to put all of the mail items grouped by delivery point in the various bins of the carrousel.

The machine also includes a bundling system 5 which is disposed at a fixed location along the path of the bins so that, by setting the carrousel 4 in motion, the bins can be brought in succession over the system 5. Once it has been brought over the system 5, each bin is emptied into a receptacle for the purpose of bundling. The bins are emptied continuously and in a manner synchronized with operation of the bundling system 5 which is organized to form a string of bags, each of which contains the contents of one bin. The successive bags in the string thus correspond to successive delivery points of the postman's walk.

FIGS. 2 and 3 show the conveyor 3 which is a conveyor on which the mail items such as the letter L and the large format object P are conveyed in the flat state between belts 8 and motor-driven rollers 9. Switching flaps 10 (three-branch flaps in this example) mounted to pivot on the rollers of the conveyor make it possible to direct each mail item from the conveyor towards one of the bins of the carrousel. FIG. 2 shows a switching flap 10 in an open position in which it directs a letter L moving in the direction D into a bin situated in register with and under the flap 10. In general, there are as many switching flaps as there are bins, and said flaps are distributed at regular intervals along the conveyor 3 in register with the bins of the carrousel while it is stationary. In particular, each switching flap 10 is disposed between two adjacent rollers spaced apart by a distance corresponding to the width of the top opening in a bin of the carrousel 4.

FIG. 2 also makes it possible to understand that a mail item is inserted into a bin from the conveyor by gravity. A read system 6 shown in FIG. 1 is mounted between the unstackers 1, 2 and the conveyor 3 for reading a bar code automatically from each serialized mail item, which bar code indicates the delivery point of the mail item. This information is sent to a control system (not shown) for selectively controlling the switching flaps 10 as the mail items are moving along the conveyor 3 so that each mail item whose delivery point has been recognized by the read system is directed automatically to the corresponding bin.

As shown in FIG. 2, in the loading position, the bins of the carrousel are held inclined relative to the vertical by a special device and by means of the fact that all of them are mounted to pivot about respective horizontal pins such as 11 at their tops. In order to obtain a controlled angle of inclination of the bins, it is possible to provide each bin with a wheel at its bottom, which wheel runs on a suitable running surface. Inclining the bins in this way makes it possible for the mail items to be inserted into the bins without jamming in them. In addition, as described below, it is preferable firstly to group together all of the large format objects by delivery point in the bins, and then to repeat this processing for the letters, thereby making it possible for the letters to be placed above the large format objects in the bins without any risk of said letters being crushed by the large format objects.

FIG. 4 diagrammatically shows the bundling system of the invention. This system enables the contents of the bins to be bagged continuously. As indicated above, the bin carrousel is set in motion so as to bring each bin successively over the system 5 where it is emptied merely by its bottom 19 being opened. As shown in FIG. 4, the bottom 19 of the bin can be opened automatically.

When the bin G has its bottom 19 open, the mail items 14 to 16 inside the bin fall under gravity between two sheet strips 17, 18 wound around respective ones of two reels 20, 21 disposed facing each other. A cell 22 is disposed for detecting when the mail items pass through the outlet of the bin G.

As shown in FIG. 4, the two sheet strips are unreeled downwards and the two strips are brought towards each other by means of presser wheels 23, 24 that are mounted to move in a direction perpendicular to the direction D' in which the string of bags is produced. The two sheet strips are preferably two films of a transparent plastics material which can be heat-sealed edge-to-edge by heater wheels 23, 24. Heater blades 25, 26 mounted to move perpendicularly to the direction D' make it possible to close the top and the bottom of each of the bags with it being possible to form a pre-cut in the region in which consecutive bags meet. Such a pre-cut makes it easy for the bags to be separated while they are being delivered by the postman.

In this bundling system, the two sheet strips 17 and 18 are unreeled stepwise and cyclically each time a full bin comes past the emptying location so that a new bag forming a hopper is prepared under the bottom of the current bin G. If the cell 22 does not detect any mail items exiting from the current bin G, a new bin is presented to the emptying location but the two sheet strips 17, 18 are not unreeled any further. With this system of bundling by bagging, the bins can be emptied continuously and a string of bags containing the contents of the bins is formed, offering the advantage of the successive bags of the string corresponding to the successive delivery points along the postman's walk. In addition, on the basis of the information delivered by the cell 22, it is possible to avoid forming bags that do not contain any mail items.

A labelling device 40 is disposed for affixing labels on the bags 30, 31, 32 as they exit from the bundling system 5. The labelling device may be organized to generate a label identifying the postman's walk and a delivery point thereof, and to affix said label on the corresponding bag produced at the outlet of the bundling system. It can be understood that the string of bags may be split up into fractions before delivery by the postman if the bag at the head of each fraction bears a label giving the information on the postman's walk and on the delivery point.

In order to prepare a postman's walk in a single pass by means of the machine shown in FIG. 1, the procedure is as follows.

The stack of large format objects in the unstacker 1 is serialized and the large format objects are grouped together by delivery points in the various bins of the carrousel. Then the stack of letters in the unstacker 2 is serialized and the letters are grouped together by delivery points in the various bins of the carrousel. Then the bin carrousel is set in motion in order to bring each bin successively over the bundling system where the bin is emptied into a receptacle. The bundling system is synchronized with the motion of the bins so that a string of bags can be constituted continuously as the bins move over the system 5. Each of the bags contains one or more mail items and they succeed one another in the order of the postman's walk.

The bags may be rectangular in shape and of size corresponding to the largest dimension of the large format objects to be processed.

The invention claimed is:

1. A method of preparing a postman's walk with mail items including at least one of letters and "large format" flat postal objects, in a single pass of each mail item through a machine, wherein said machine includes: a conveyor for moving in series said mail items over bins of a bin carrousel, said conveyor having switching flaps distributed at regular intervals along the conveyor for directing each mail item towards one of the bins of the carrousel corresponding to a delivery point of the postman's walk; said bin carrousel with bins being disposed in a loading position respectively in register under corresponding switching flaps of the conveyor, each bin in a loading position being held inclined relatively to a vertical direction and having a top opening which is in register with a corresponding switching flap and a bottom opening which is held closed; and a bundling system under said bin carrousel for bagging the content of successive bins of the bin carrousel respectively in successive bags of a string of bags made from two strips of plastic material unreeled stepwise by presser wheel means and closed by heater blades means, wherein said method comprises the steps of setting said bin carrousel in a stationary state so that the bins of the carrousel corresponding to said delivery points are in a loading position in register with the switching flaps of the conveyor, actuating said conveyor for directing by delivery points the mail items through said switching flaps towards the bins in a loading position, when all the mail items of a postman's walk are loaded in the bins of said bin carrousel, a) actuating said bin carrousel to move a current bin over the bundling system and causing automatically the bottom of said current bin to be opened over said bundling system in which a current opened bag is prepared, b) detecting by a cell of said bundling system that mail items pass through the bottom opening of said current bin and in response to said detection, c.1) actuating said bundling system for closing said current bag, c.2) actuating said bundling system for stepwise unreeling said strips of plastic material in order to prepare a new opened current bag in said bundling system, c.3) actuating said bin carrousel for moving a new current bin over said bundling system causing automatically the bottom of said new current bin to be opened over said bundling system, c.4) detecting by said cell that mail items pass through the bottom opening of said new current bin and in response to said detection for said current bin, repeating steps c.1) to c.4) and in response to absence of said detection for said current bin, repeating steps c.3) to c.4).

2. A method according to claim 1, comprising a step of affixing a label on each bag of mail items produced by said bundling system, each label identifying the postman's walk and a delivery point thereof.

3. A method according to claim 1, wherein said mail items include both letters and large format flat postal objects.

4. A method according to claim 3, wherein both letters and large format flat postal objects are mixed together on said conveyor during said step of actuating said conveyor.

5. A method according to claim 3, wherein said letters and large format flat postal objects are arranged into respective groups before said step of actuating said conveyor.

6. A method according to claim 5, in which firstly the large format objects are moved over the bins of the bin carrousel in order to group said large format objects together by delivery points in the bins, this processing then being repeated for the letters.

* * * * *